US005740597A

United States Patent [19]

Eto

[11] Patent Number: 5,740,597

[45] Date of Patent: Apr. 21, 1998

[54] POCKET COIL SPRING PRODUCING APPARATUS

[75] Inventor: Hiroyuki Eto, Tokyo, Japan

[73] Assignee: Matsushita Industrial Co., Ltd., Osaka, Japan

[21] Appl. No.: 708,417

[22] Filed: Sep. 5, 1996

[30] Foreign Application Priority Data

Dec. 25, 1995 [JP] Japan ..... 7-337202

[51] Int. Cl.[6] ..... B65B 9/06

[52] U.S. Cl. ..... 29/33 E; 53/114; 53/450

[58] Field of Search ..... 29/33 R, 33 E; 53/450, 114; 140/92.7; 72/135, 132, 137, 138

[56] References Cited

U.S. PATENT DOCUMENTS

| | | | |
|---|---|---|---|
| 1,915,264 | 6/1933 | Schneider et al. | 53/114 |
| 2,663,475 | 12/1953 | McInerney et al. | 53/114 |
| 4,111,241 | 9/1978 | Crown | 140/92.7 |
| 4,565,046 | 1/1986 | Stumpf | 53/114 |
| 4,713,956 | 12/1987 | Sasuki et al. | 72/137 |
| 5,553,443 | 9/1996 | St. Clair | 53/450 |

*Primary Examiner*—William R. Briggs
*Attorney, Agent, or Firm*—Wenderoth, Lind & Ponack

[57] ABSTRACT

A pocket coil spring producing apparatus includes a coil spring forming mechanism for forming coil springs, a hardening mechanism for hardening coil springs fed from the coil spring forming mechanism, a conveyor mechanism for cooling and conveying the hardened coil springs, and a compress inserting mechanism for compressing and inserting the coil springs conveyed by the conveyor mechanism into a two-fold sheet form of a sheet material. A sheet supplying mechanism folds the sheet material in two and feeds the same. A joining mechanism joins the two-fold form of the sheet material to have a row of substantially rectangular pouches into which are supplied respective of the compressed coil springs. A spring alignment mechanism aligns each compressed coil spring in a respective pouch in a lengthwise direction to return to a free, released state. A control mechanism controls the foregoing mechanisms.

5 Claims, 4 Drawing Sheets

POCKET COIL SPRING PRODUCING APPARATUS

BACKGROUND OF THE INVENTION

The present invention relates to an apparatus of making cushion members known as pocket coil springs which consist of a row of coil springs installed in respective pocket like pouches of cylindrical shape made of a non-woven fabric or plain cloth material for use in a sofa or a chair.

Conventional pocket coil producing apparatuses do not include a device for hardening the coil springs. As the coil springs are not subjected to hardening, they will have low resiliency and durability. For compensation, the coil springs are selected of a costly, oil tempered wire material. The conventional pocket coil spring producing apparatus includes a mechanism for compressing and inserting the coil springs into the non-woven fabric. Such a mechanism comprises a compressing disk mounted to the distal end of a rod of a long-stroke cylinder for compressing from above each coil spring in a standing state in a tubular guide before the coil spring is inserted horizontally into the non-woven fabric. This mechanism however holds the supply of the succeeding coil spring until the compressing disk is retracted back to its upper position, hence contributing to lowering speed of production.

It is an object of the present invention to provide an improved pocket coil spring producing apparatus capable of producing pocket coil springs of uniform size and high quality automatically and efficiently, thus eliminating deficiencies of resiliency, durability, and production speed of the conventional apparatus.

SUMMARY OF THE INVENTION

For achievement of the above object, the present invention provides a pocket coil spring producing apparatus including a coil spring forming mechanism for forming coil springs of interest, a hardening mechanism for hardening the coil springs fed from the coil spring forming mechanism, a conveyor mechanism for cooling and conveying the hardened coil springs, a compress inserting mechanism for compressing and inserting the coil springs conveyed by the conveyor mechanism into a two-fold sheet form of a sheet material, a sheet supplying mechanism for folding the sheet material in two and feeding the same, a joining mechanism for joining the two-fold form of the sheet material to have a row of substantially rectangular pouches to receive therein respective of compressed coil springs, a spring alignment mechanism for aligning the compressed coil springs in their respective pouches in a lengthwise direction to return to a free, released state, and a control mechanism for controlling the foregoing mechanisms.

The conveyor mechanism of the pocket coil spring producing apparatus includes an endless belt driven by a driving means and a row of coil spring support bars implanted on the endless belt for supporting inner sides of the coil springs fed from the coil spring forming mechanism.

The hardening mechanism of the pocket coil spring producing apparatus includes two energizing members connected to respective electrodes for directly engaging with upper and lower ends of the coil springs, respectively.

The compress inserting mechanism of the pocket coil spring apparatus includes a pair of guide plates for guiding and transferring the compressed coil springs held at radial ends thereof, a pair of coil spring guides mounted on start ends of the guide plates opposite to each other so as to have a coil spring compressing slit in a substantial center therebetween, compressing bars for compressing the coil springs while passing through the coil spring compressing slit between the coil spring guides, and a feeder mechanism for feeding the compressed coil springs to between the guide plates.

The feeder mechanism of the pocket coil spring producing apparatus includes a feed finger, and each of the compressing bars has a slit at its distal end for passage of the feed finger, the length of the slit including a portion which moves across the coil spring compressing slit.

DETAILED DESCRIPTION OF THE PREFERRED EMBODIMENTS

Figure 1:
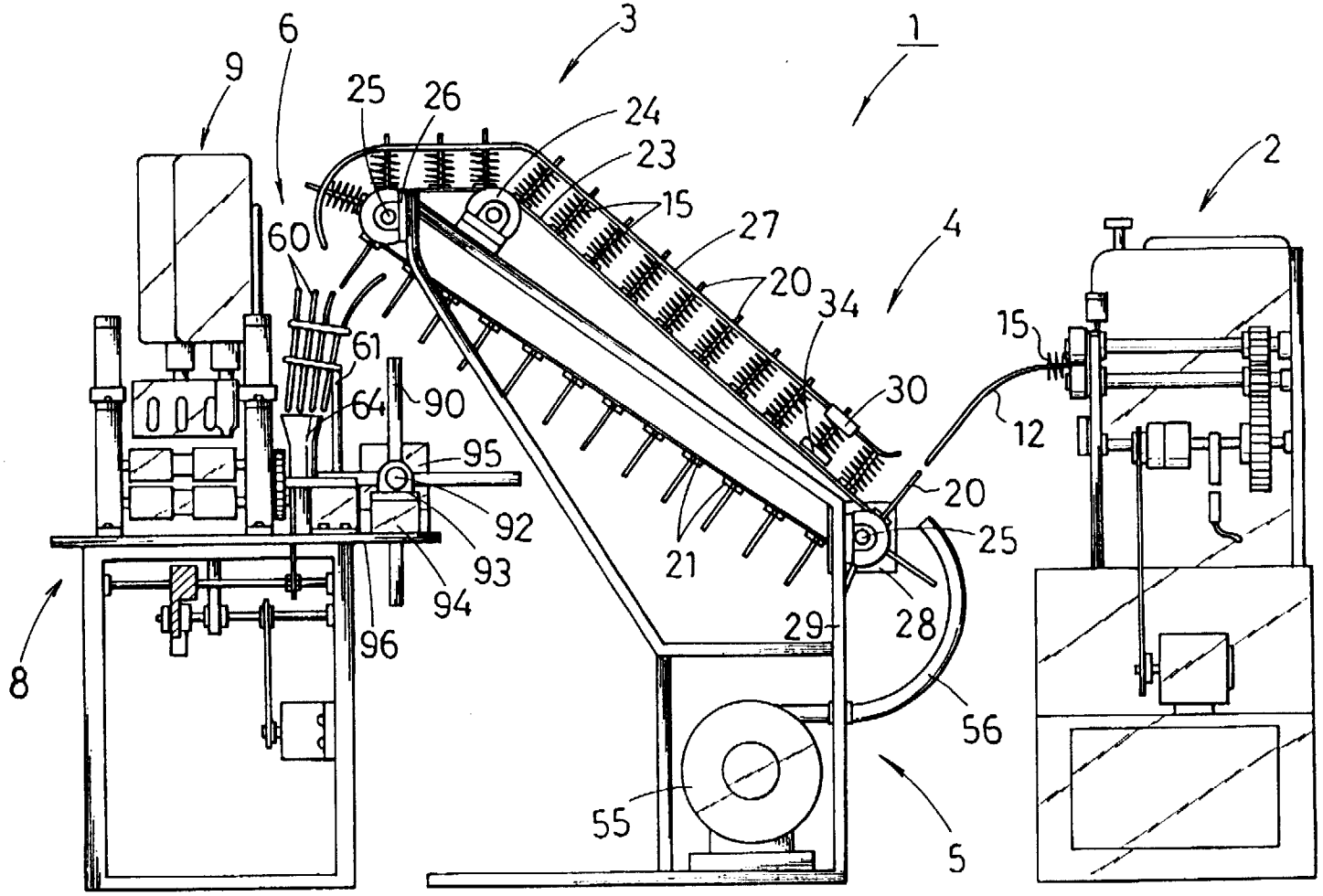
FIG. 1 is a side view of the entire arrangement of a pocket coil spring producing apparatus according to the present invention.

A pocked coil spring producing apparatus according to the present invention will be described in more detail referring to the accompanying drawings. FIG. 1 is a schematic side view of the pocket coil spring producing apparatus which is represented as a whole by the numeral 1.

The pocket coil spring producing apparatus 1 comprises a coil spring forming mechanism 2 for forming a coil spring 15 from a wire material, a hardening and cooling conveyor mechanism 3 consisting mainly of a combination (mechanism) of a hardening unit 4 and a cooling unit 5 for receiving a plurality of coil springs 15 from the coil spring forming mechanism 2, supporting the inner side of the same with a row of coil spring support bars 20, and subjecting the same to hardening and cooling during intermittent conveying movement to a compress inserting mechanism 6. The compress inserting mechanism 6 compresses and inserts the coil springs 15 fed from the hardening and cooling conveyor mechanism 3 into a two-fold form of non-woven fabric (sheet) 16 (see FIG. 3). A non-woven fabric supplying mechanism (sheet supplying mechanism) 7 having a guide 17 (see FIG. 2) supports a roll of the non-woven fabric 16 and folds the non-woven fabric 16 in two. A non-woven fabric transfer mechanism 8 transfers the two-fold form of the non-woven fabric 16 at equal intervals of a predetermined distance. A fusing mechanism 9 (a joining mechanism) sealingly fuses the two-fold form of the non-woven fabric 16 to have seal-fused lines 101 and 102 (see FIG. 3). A spring raising mechanism 10 (a spring alignment mechanism) (see FIG. 2) turns by 90 degrees the coil springs 15 of compressed form in the non-woven fabric 16 with the seal-fused lines 101 and 102. A controller mechanism 11 (see FIG. 2) controls the foregoing mechanisms.

The coil spring forming mechanism 2, the non-woven fabric supplying mechanism 7, the fusing mechanism 9, and the spring raising mechanism 10 are well known and used worldwide, and their constructions are not novel and will be explained in no more detail.

As shown in FIG. 1, the hardening and cooling conveyor mechanism 3 includes a conveyor means or two endless drive chains 23 for supporting by the coil spring support bars 20 the inner sides of respective coil springs 15 fed intermittently in a succession from the coil spring forming mechanism 2 and intermittently conveying the same to the compress inserting mechanism 6, the hardening unit 4 for hardening the coil springs 15 which are supported at inner sides thereof by respective coil spring support bars 20 and held at upper and lower, outer ends thereof, and the cooling unit 5 for blowing a flow of air to cool the coil springs 15 supported by respective coil spring support bars 20 and conveyed intermittently after being hardened at the hardening unit 4.

The coil spring support bars 20 in the hardening and cooling conveyor mechanism 3 are arranged to extend vertically from respective coil spring support bar bases 21. The coil spring support bar bases 21 are fixedly mounted by screws 22 to the two endless drive chains 23 which run along three double sprockets 24 (see FIG. 2). Each of the three double sprockets 24 is fixedly mounted on a shaft 25 which is supported at both ends by a pair of pillow blocks 26. The pillow blocks 26 are fixedly mounted to a main frame 29 of the apparatus. One of the shafts 25 disposed adjacent to the coil spring forming mechanism 2 is linked by a coupling (not shown) to the output rotating shaft (not shown) of an index motor 28. The index motor 28 is also secured to the main frame 29. The coil spring support bars 20 are arranged at equal intervals of a distance which corresponds to one pitch of the rotation of the index motor 28. The coil spring support bars 20 supporting respective coil springs 15 fed from the coil spring forming mechanism 2 are successively stopped at an intermittent stop location which is located across the extension line of a chute 12 of the coil spring forming mechanism 2. Also, the coil spring support bars 20 are successively stopped at another intermittent stop location (see FIG. 2) over the compress inserting mechanism 6 which is located so as to allow the coil springs 15 to drop down from their respective coil spring support bars 20 into a chute 60 of the compress inserting mechanism 6. Two guides 27 are disposed for guiding the row of the coil spring support bars 20 from both sides to prevent the coil springs 15 on their respective coil spring support bars 20 from falling off during the intermittent conveying.

Figure 4:
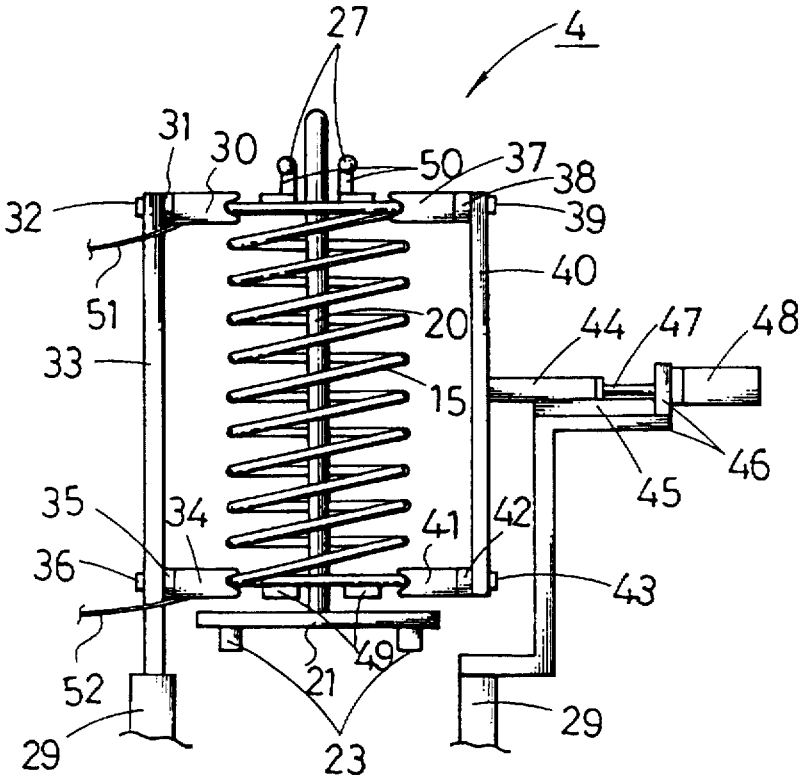
FIG. 4 is a cross sectional view of a hardening mechanism according to the present invention.
Figure 5:
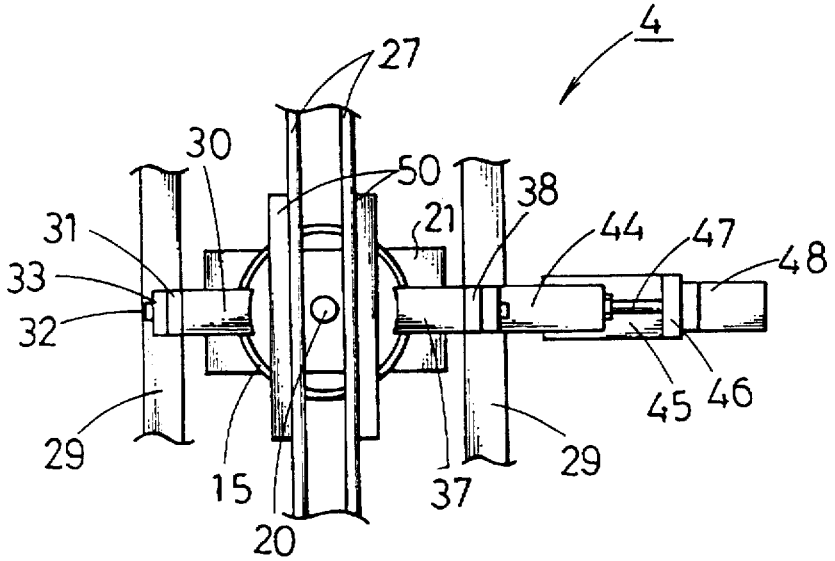
FIG. 5 is an upper view of the hardening mechanism.

The hardening unit 4 is located to align with the first or second of the row of the coil spring support bars 20, moving in the conveying direction, from the intermittent stop location in the hardening and cooling conveyor mechanism 3 where the coil springs 15 are fed from the coil spring forming mechanism 2. As shown in FIGS. 4 and 5, the hardening unit 4 includes an upper hardening strip 30 fixedly mounted by an insulator shim 31 and a screw 32 to a support plate 33 to engage with the uppermost outer edge of each of the coil springs 15 on their respective coil spring support bars 20. The support plate 33 is secured to the main frame 29. The upper hardening strip 30 is connected to an electric lead line 51. Similarly, a lower hardening strip 3 is fixedly mounted by an insulator shim 35 and a screw 36 to, the support plate 33 to engage with the lowermost outer edge of each of the coil springs 15 on their respective coil spring support bars 20. The lower hardening strip 34 is connected to an electric lead line 52. There is also an upper holding strip 37 fixedly mounted by an insulator shim 38 and a screw 39 to a slide support plate 40 to engage with the uppermost outer edge of each of the coil springs 15 opposite to the upper hardening strip 30. Similarly, a lower holding strip 41 is fixedly mounted by an insulator shim 42 and a screw 43 to the slide support plate 40 to engage with the lowermost outer edge of each of the coil springs 15 opposite to the lower hardening strip 34. The slide support plate 40 is fixedly mounted to a slider 44 which in turn is coupled to the cylinder rod 47 of a cylinder 48. The cylinder 48 is secured to a stationary mount 46. Also, a slider guide 45 is secured to the stationary mount 46. The stationary mount 46 is fixedly mounted to the main frame 29. In addition, two insulator guide rails 49 and 50 have electrically insulated surfaces to be in contact with the coil springs 15.

The cooling unit 5 (see FIG. 1) in the hardening and cooling conveyor mechanism 3 comprises a blower 55 and a hose 56 having an outlet located so as to direct a flow of air from the blower 55 towards the row of the coil springs 15 supported at inner sides thereof by respective coil spring support bars 20.

Accordingly, the hardening and cooling conveyor mechanism 3 allows the coil springs 15 formed and fed from the coil spring forming mechanism 2 to be effectively hardened and cooled at high efficiency during conveying to the compress insertion mechanism 6.

Figure 2:
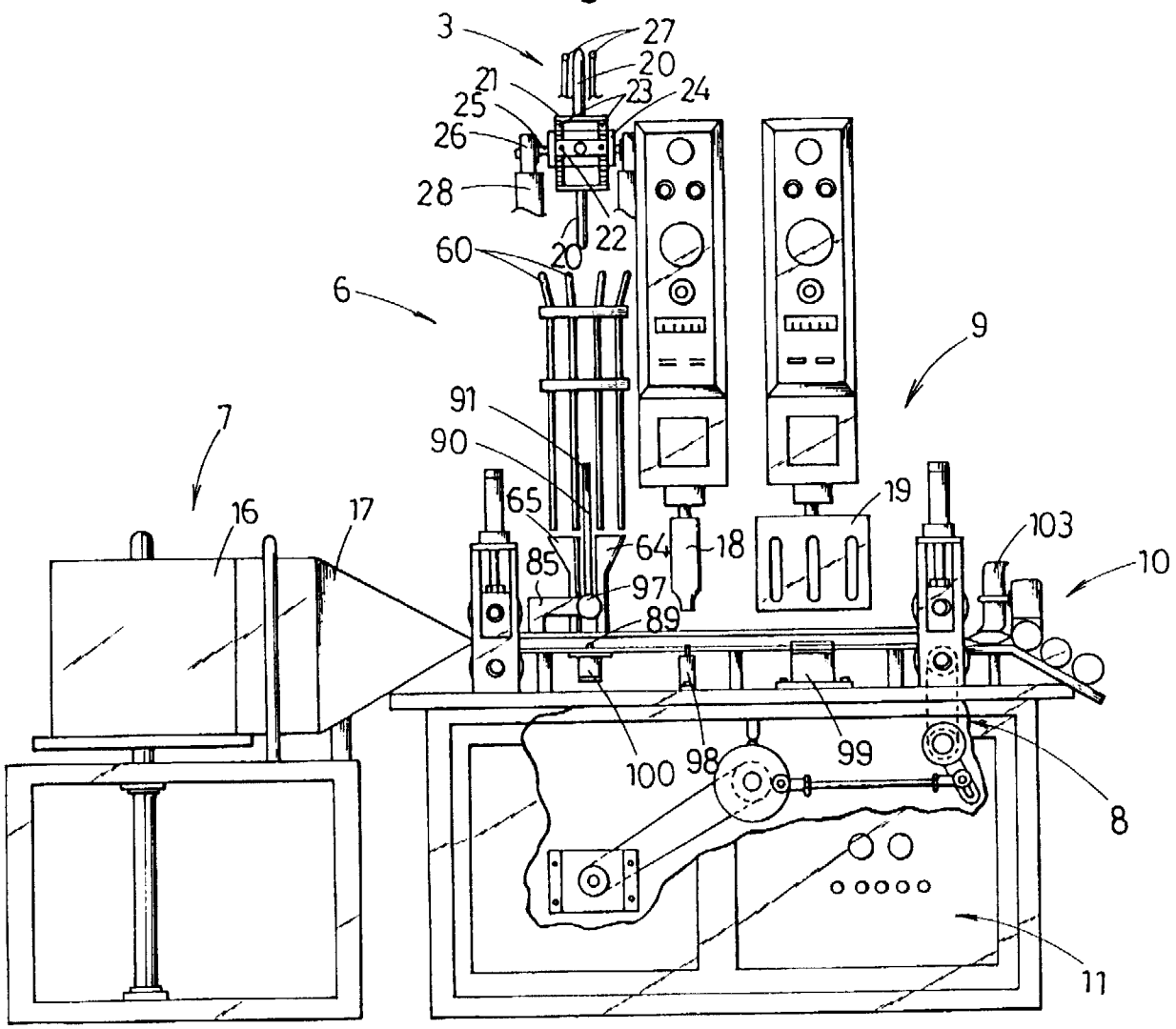
FIG. 2 is a partially cutaway front view of the pocket coil spring producing apparatus.
Figure 3:
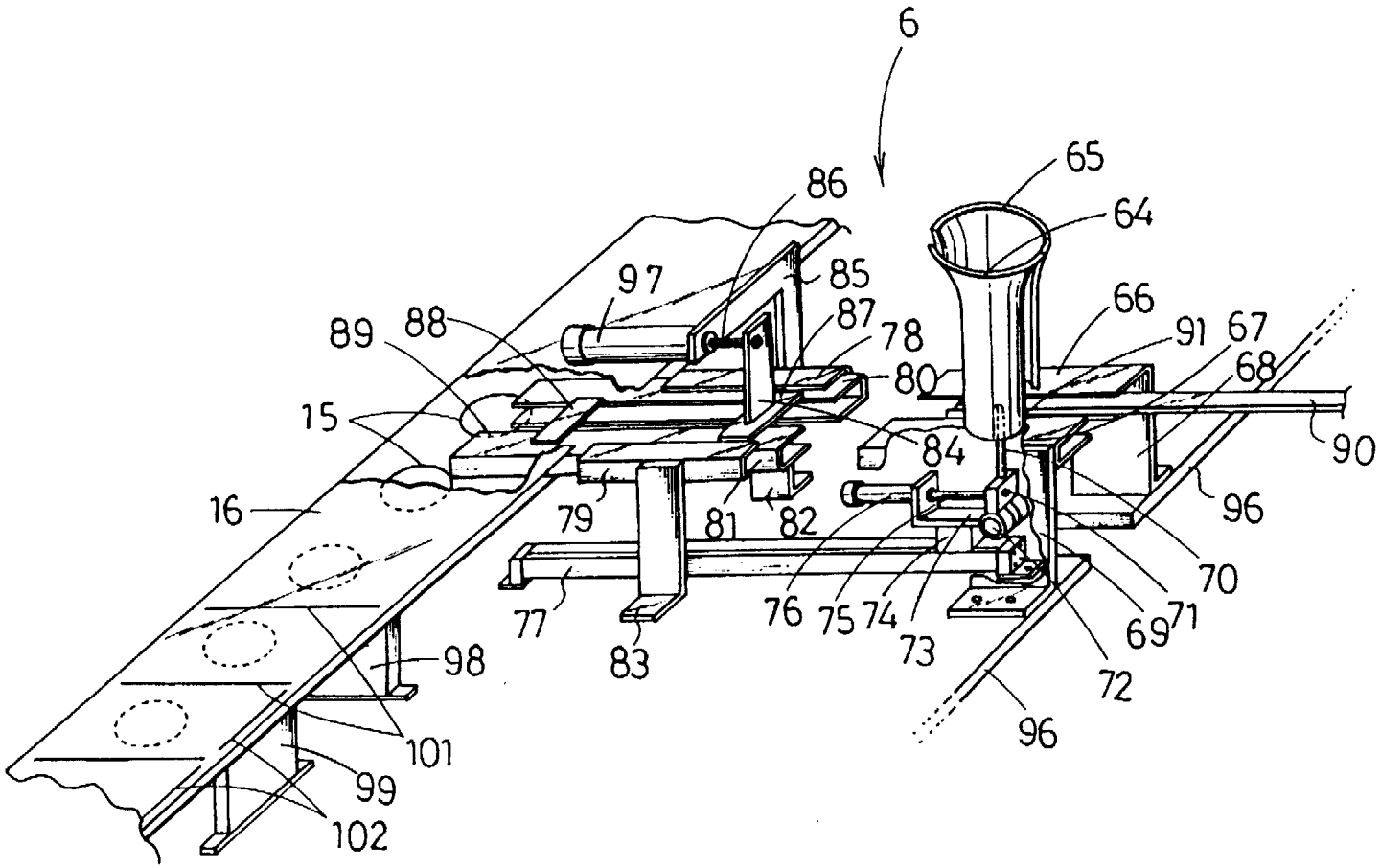
FIG. 3 is a partially cutaway perspective view of a compress inserting mechanism according to the present invention.

As shown in FIGS. 2 and 3, the compress inserting mechanism 6 includes a right coil spring guide 65 fixedly mounted at the lowermost inner side thereof to a curved recessed edge of a right stationary compression guide 66. Similarly, a left coil spring guide 64 fixedly mounted at the lowermost inner side thereof to a curved recessed edge of a left stationary compression guide 67. The right stationary compression guide 66 and left stationary compression guide 67 are secured to a right support 68 and a left support 69, respectively. Both the right support 68 and left support 69 are fixedly mounted to a main construction or frame member 96. There is a space between the right coil spring guide 65 and the left coil spring guide 64 for clearing or passage therebetween of turnable compressing bars 90.

The turnable compressing bars 90 (see FIG. 1), each having a cutout 91 (see FIG. 3) provided in the distal end thereof for passage of a feed finger 70, are radially mounted at equal intervals on a rotary shaft 92. The rotary shaft 92 is supported by a pair of pillow blocks 93 which are fixedly mounted to the main construction 96. One end of the rotary shaft 92 is joined by a coupling (not shown) to the rotary output shaft (not shown) of an index motor 95. A unit distance (one feeding pitch) of rotating movement of the index shaft 95 corresponds to a movement of each of the turnable compressing bars 90 to a horizontal position thereof for compressing a respective coil spring 15 located between the right coil guide 65 and the left coil guide 64.

The feed finger 70 has a distal portion thereof bent towards the path of movement of the non-woven fabric 16 for holding the inner side of the compressed coil spring 15 and is vertically mounted at the proximal end on a finger base 71. The finger base 71 is pivotably mounted on a support pin 72 and joined to the cylinder rod 75 of a cylinder 76. The cylinder 76 is secured to a cylinder mount 73. The support pin 72 is also mounted at center thereof on the cylinder mount 73. The cylinder mount 73 is fixedly mounted to a slider 74. A rodless cylinder 77 is secured to the main construction 96.

A right feeding compression guide 80 (see FIG. 3) is movably provided along an extension line of the right stationary compression guide 66. Also, a left feeding compression guide 81 (see FIG. 3) is movably provided along an extension line of the left stationary compression guide 67. The feeding compression guides 80 and 81 are joined to each other by a pair of front and rear joint strips 87, 88 and are slidably supported between right and left guide rails 78, 79. The right guide rail 78 is fixedly mounted to a right stationary mount 82 which is secured to the main construction 96. The left guide rail 79 is fixedly mounted to a left stationary mount 83 which is secured to the main construction 96. The front joint strip 87 is linked by a plate 84 to the cylinder rod 86 of a cylinder 97. The cylinder 97 is fixedly mounted to a cylinder mount 85 which is secured to the main construction 96. A coil support pin 89 is fixedly mounted on the distal end of a cylinder rod of a cylinder 100.

As the compress insertion mechanism 6 is actuated, each of the coil springs 15 dropping from the hardening and cooling conveyor mechanism 3 while being guided at the outer side by the chute 60 is received in an upright or standing state between the two coil spring guides 65 and 64. The index motor 95 (see FIG. 1) drives one of the rotary compressing bars 90 in a horizontal state or position thereof between the two coil spring guides 65 and 64 to move down, and simultaneously to drive the succeeding rotary compression bar 90 to lower and compress from above the coil spring 15 which has been loaded and stays in its standing state between the two coil spring guides 65 and 64. When the succeeding rotary compressing bar 90 stops its lowering movement at the horizontal state or position thereof, the feed finger 70 in its standing state is located just beneath the compressed coil spring 15 while the feeding compression guides 80 and 81 (see FIG. 3) stay next to the two stationary compression guides 66 and 67 for standby. Also, as the coil spring 15 between the two coil spring guides 65 and 64 is being compressed by the rotary compressing bar 90, the next coil spring 15 is about to be fed from the hardening and cooling conveyor mechanism 3.

The rodless cylinder 77 then drives the feed finger 70 to catch the inner side of the coil spring 15 compressed by the rotary compressing bar 90 and transfers the same from the stationary compression guides 66 and 67 through the feeding compression guides 80 and 81 until the center of the compressed coil spring 15 comes to a feeding end, adjacent to the non-woven fabric 16, of the feeding compression guides 80 and 81. Upon such transfer being completed, the rodless cylinder 77 actuates returning of the feed finger 70 to its home position. As the feed finger 70 so returns, it is tilted down by the action of the cylinder 76 and will never catch and move back the transferred coil spring 15.

The cylinder 97 is then actuated to advance the feeding compression guides 80 and 81 holding at their feeding end the compressed coil spring 15 until the compressed coil spring 15 is loaded into a respective pouch with its center aligned with the center of the two-fold form of the non-woven fabric 16. This is followed by upward movement of the cylinder 100 located beneath the loaded coil spring 15 for driving the coil support pin 89 mounted on the rod of cylinder 100 to project from below into the two-fold form of the non-woven fabric 16 and hold the inner side of the coil spring 15. Upon the coil support pin 89 being thus projected, the cylinder 97 moves back the feeding compression guides 80 and 81 to the stationary compression guides 66 and 67 for receiving the next coil spring 15. Meanwhile, the loaded coil spring 15 stays in the pouch of two-fold form of the non-woven fabric 16 by being held at its inner side by the coil support pin 89. Then, the coil support pin 89 is retracted to release the loaded coil spring 15.

When the coil support pin 89 has been retracted, the non-woven fabric transfer mechanism 8 is actuated to transfer the two-fold form of the non-woven fabric 16 intermittently to the spring raising mechanism 10. As the two-fold form of the non-woven fabric 16 is transferred, its loaded coil springs travel forwardly.

By repeating the above procedure, the coil springs fed from the hardening and cooling conveyor mechanism 3 can readily be loaded in succession into the two-fold form of the non-woven fabric 16 without error.

What is claimed is:

1. A pocket coil spring producing apparatus comprising:

a sheet supplying mechanism for folding a sheet material in two and feeding the same;

a joining mechanism for joining the thus folded sheet material to form a row of substantially rectangular pouches;

a coil spring forming mechanism for forming coil springs;

a hardening mechanism for hardening the coil springs fed from said coil spring forming mechanism;

a conveyor mechanism for cooling and conveying the thus hardened coil springs; and a compress inserting mechanism for compressing and inserting the coil springs conveyed by said conveyor mechanism into respective pouches of the sheet material, said compress inserting mechanism comprising a pair of coil spring guides mounted at a position to receive a coil spring from said conveyor mechanism, said guides being spaced from each other to define therebetween a coil spring compressing slit, compressing bars for compressing respective coil springs received between said guides by passing through said coil spring compressing slit between said guides, a pair of guide plates for guiding and transferring the compressed coil springs while holding radial sides thereof, and a feeder mechanism for feeding the compressed coil springs to between said guide plates.

2. A pocket coil spring producing apparatus as claimed in claim 1, wherein said conveyor mechanism comprises an endless belt driven by a driving means, and a row of coil spring support bars fixed to said endless belt for supporting inner sides of the coil springs fed from said coil spring forming mechanism.

3. A pocket coil spring producing apparatus as claimed in claim 2, wherein said hardening mechanism comprises two energizing members connected to respective electrodes and positioned to directly engage with respective upper and lower ends of the coil springs.

4. A pocket coil spring producing apparatus as claimed in claim 1, wherein said hardening mechanism comprises two energizing members connected to respective electrodes and positioned to directly engage with respective upper and lower ends of the coil springs.

5. A pocket coil spring producing apparatus as claimed in claim 1, wherein said feeder mechanism comprises a feed finger, and each of said compressing bars has at a distal end thereof a slit for passage of said feed finger, each said slit in each said compressing bar including a portion which moves across said coil spring compressing slit.

* * * * *